US010363771B2

(12) United States Patent
Sadeghi

(10) Patent No.: US 10,363,771 B2
(45) Date of Patent: Jul. 30, 2019

(54) PAPER BINDING DEVICE

(71) Applicant: Faramarz Sadeghi, Beverly Hills, CA (US)

(72) Inventor: Faramarz Sadeghi, Beverly Hills, CA (US)

( * ) Notice: Subject to any disclaimer, the term of this patent is extended or adjusted under 35 U.S.C. 154(b) by 0 days.

(21) Appl. No.: 15/852,210

(22) Filed: Dec. 22, 2017

(65) Prior Publication Data

US 2018/0178580 A1 Jun. 28, 2018

Related U.S. Application Data

(60) Provisional application No. 62/439,436, filed on Dec. 27, 2016.

(51) Int. Cl.

| | |
|---|---|
| ***B42F 13/12*** | (2006.01) |
| ***B42F 3/00*** | (2006.01) |
| ***B42F 13/02*** | (2006.01) |

(52) U.S. Cl.

CPC ..... *B42F 13/12* (2013.01); *B42F 3/003* (2013.01); *B42F 13/02* (2013.01)

(58) Field of Classification Search

CPC ..... B42F 13/12; B42F 3/003; B42F 13/02

USPC ..... 402/4, 7, 8, 14, 15, 19, 60, 500

See application file for complete search history.

(56) References Cited

U.S. PATENT DOCUMENTS 4,606,666 A * 8/1986 Patton ..... B42F 13/14 402/62

* cited by examiner

*Primary Examiner* — Justin V Lewis

(74) *Attorney, Agent, or Firm* — Hackler Daghighian Martino & Novak

(57) ABSTRACT

A paper binding device is configured to hold a plurality of paper sheets together utilizing aligned holes formed in each of the plurality of sheets. A plurality of bendable extensions extend from at least one flat first surface of a first elongated part. Each of the plurality of bendable extensions includes two cylindrically-shaped posts disposed adjacent to one another and separated by a gap. A plurality of bridges connect the two cylindrically-shaped posts along the gap. A second part includes a plurality of through apertures which are disposed from at least one flat second surface through to an opposite surface. A plurality of elongated channels are openly formed in the opposite surface. The plurality of bendable extensions are fitted through the plurality of through apertures and are configured to be manipulated by a user to bend and lock into the plurality of elongated channels.

20 Claims, 10 Drawing Sheets

PAPER BINDING DEVICE

CROSS-REFERENCE TO RELATED APPLICATIONS

This non-provisional patent application claims priority to provisional application 62/439,436 filed on Dec. 27, 2016, the entire contents of which are incorporated herein with this reference.

FIELD OF THE INVENTION

The present invention generally relates to devices that bind paper. More particularly, the present invention relates to a paper binding device that improves the reliability and ease of use in comparison to previous designs.

BACKGROUND OF THE INVENTION

FIG. 1 is a perspective view of a prior art paper binding device 10 configured to hold a plurality of paper sheets together utilizing aligned holes formed in each of the plurality of sheets. The paper binding device includes a first part 12 and a second part 14. FIG. 2 is a sectional view of the structure of FIG. 1 taken along lines 2-2 and FIG. 3 is a sectional view of the structure of FIG. 1 taken along lines 3-3. FIG. 4 is a perspective view of the prior art paper binding device of FIG. 1 now in a partially closed position where the two outer bendable extensions are locked in their respective channels.

The first part 12 includes a first elongated strip elongated along a first longitudinal direction 16. A first cross-section through the first elongated strip 12 perpendicular to the first longitudinal direction 16 has a first outer perimeter shape which includes at least one flat first surface 18. A plurality of bendable extensions 20 extend from the at least one flat first surface 18, wherein the plurality of bendable extensions 20 are spaced along the first longitudinal direction. The plurality of bendable extensions 20 extend perpendicular from the at least one flat first surface 18 to each of their respective distal ends.

The second part 14 includes a second elongated strip elongated along a second longitudinal direction 22. A second cross-section through the second elongated strip perpendicular to the second longitudinal direction 22 has a second outer perimeter shape which includes at least one flat second surface 24, which is the underside of part 14 as shown in FIG. 1. A plurality of through apertures 26 are disposed from the at least one flat second surface 24 through to an opposite surface 28. The plurality of through apertures 26 are matched to the plurality of bendable extensions 20 when the first and second parts are mutually aligned to another along the same first and second longitudinal directions. A plurality of elongated channels 30 are openly formed in the opposite surface along the second longitudinal direction, wherein each elongated channel of the plurality of elongated channels starts at its respective through aperture 26 and extends to a respective channel end 32. Each elongated channel comprises a channel opening 34 along the opposite surface which is smaller than a widest portion of the channel 36 disposed within the second elongated strip.

When the at least one flat first surface 18 is disposed facing the at least one flat second surface 24 and the plurality of bendable extensions 20 are fitted through the plurality of through apertures 26, the plurality of bendable extensions are configured to be manipulated by a user to bend and lock into the plurality of elongated channels as shown in FIG. 4.

In this figure, the two outer bendable extensions 20 have been bent over by the user and they have then locked into their respective channels. In this way the papers that would be between the two flat surfaces would be fully captured and bound.

One of the problems with the prior art designs is that the hole spacing is not conducive to using pre-punched paper sheets that come in standard hole spacing and sizes. Typically, the prior art designs utilize hole spacing that are not standard and require special paper punching tooling to create the holes to begin with. Furthermore, the prior art designs are weak in that they don't properly hold paper together under rigorous use. This is because the bendable posts are too thin and don't properly bind the papers in a secure manner. Accordingly, there is a need for an improved design that overcomes these problems. The present invention fulfills these needs and provides other related advantages.

SUMMARY OF THE INVENTION

An exemplary embodiment of the present invention includes a paper binding device configured to hold a plurality of paper sheets together utilizing aligned holes formed in each of the plurality of sheets. The paper binding device includes a first part and a second part. The first part includes a first elongated strip elongated along a first longitudinal direction. A first cross-section through the first elongated strip perpendicular to the first longitudinal direction has a first outer perimeter shape which includes at least one flat first surface. A plurality of bendable extensions extend from the at least one flat first surface, wherein the plurality of bendable extensions are spaced along the first longitudinal direction. Each of the plurality of bendable extensions includes two cylindrically-shaped posts disposed adjacent to one another and separated by a gap. The two cylindrically-shaped posts are connected at each of their proximal ends to the at least one flat first surface. The two cylindrically-shaped posts extend perpendicular from the at least one flat first surface to each of their respective distal ends. The two cylindrically-shaped posts define an alignment line passing through a center of each of the two cylindrically-shaped posts, wherein the alignment line is perpendicular to the first longitudinal direction. A plurality of bridges connecting the two cylindrically-shaped posts along the gap, wherein the plurality of bridges are generally spaced between the proximal end and distal end of the two cylindrically-shaped posts.

A second part includes a second elongated strip elongated along a second longitudinal direction. A second cross-section through the second elongated strip perpendicular to the second longitudinal direction has a second outer perimeter shape which includes at least one flat second surface. A plurality of through apertures are disposed from the at least one flat second surface through to an opposite surface. The plurality of through apertures are matched to the plurality of bendable extensions when the first and second parts are mutually aligned to another along the same first and second longitudinal directions. A plurality of elongated channels are openly formed in the opposite surface along the second longitudinal direction, wherein each elongated channel of the plurality of elongated channels starts at its respective through aperture and extends to a respective channel end. Each elongated channel comprises a channel opening along the opposite surface which is smaller than a widest portion of the channel disposed within the second elongated strip.

When the at least one flat first surface is disposed facing the at least one flat second surface and the plurality of bendable extensions are fitted through the plurality of through apertures, the plurality of bendable extensions are configured to be manipulated by a user to bend and lock into the plurality of elongated channels.

In other exemplary embodiments, the first elongated strip and plurality of bendable extensions may be integrally formed as one continuous material. The first part may be an injection molded polymer. The second part may be an injection molded polymer.

The first elongated strip may be rectangular cuboid shaped. The second elongated strip may be rectangular cuboid shaped.

The plurality of bendable extensions may include at least two bendable extensions. The plurality of bridges may include at least two bridges.

The first part and second part may be made from a same mold during an injection molding process.

A third part may include a third elongated strip elongated along a third longitudinal direction, wherein the third part is configured to slidably engage with the second part where then the plurality of elongated channels are covered by the third part. The first part, second part and third part may be made from a same mold during an injection molding process.

The second elongated strip includes a pair of ridges disposed on opposite sides and extending the opposite surface while also being elongated along the second longitudinal direction. A third part includes a third elongated strip elongated along a third longitudinal direction, wherein a third cross-section through the third elongated strip perpendicular to the third longitudinal direction has a third outer perimeter shape which includes a cover surface with two oppositely disposed inwardly facing channels configured to receive the pair of ridges of the second elongated strip. The third part is configured to slidably engage with the second part where then the plurality of elongated channels are covered by the cover surface of the third part.

The second elongated strip may include two oppositely disposed outwardly facing channels disposed along the second longitudinal direction. A third part may include a third elongated strip elongated along a third longitudinal direction, wherein a third cross-section through the third elongated strip perpendicular to the third longitudinal direction has a third outer perimeter shape which includes a cover surface with two oppositely disposed inwardly facing ridges configured to engaged the two oppositely disposed outwardly facing channels of the second part. The third part is configured to slidably engage with the second part where then the plurality of elongated channels are covered by the cover surface of the third part.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
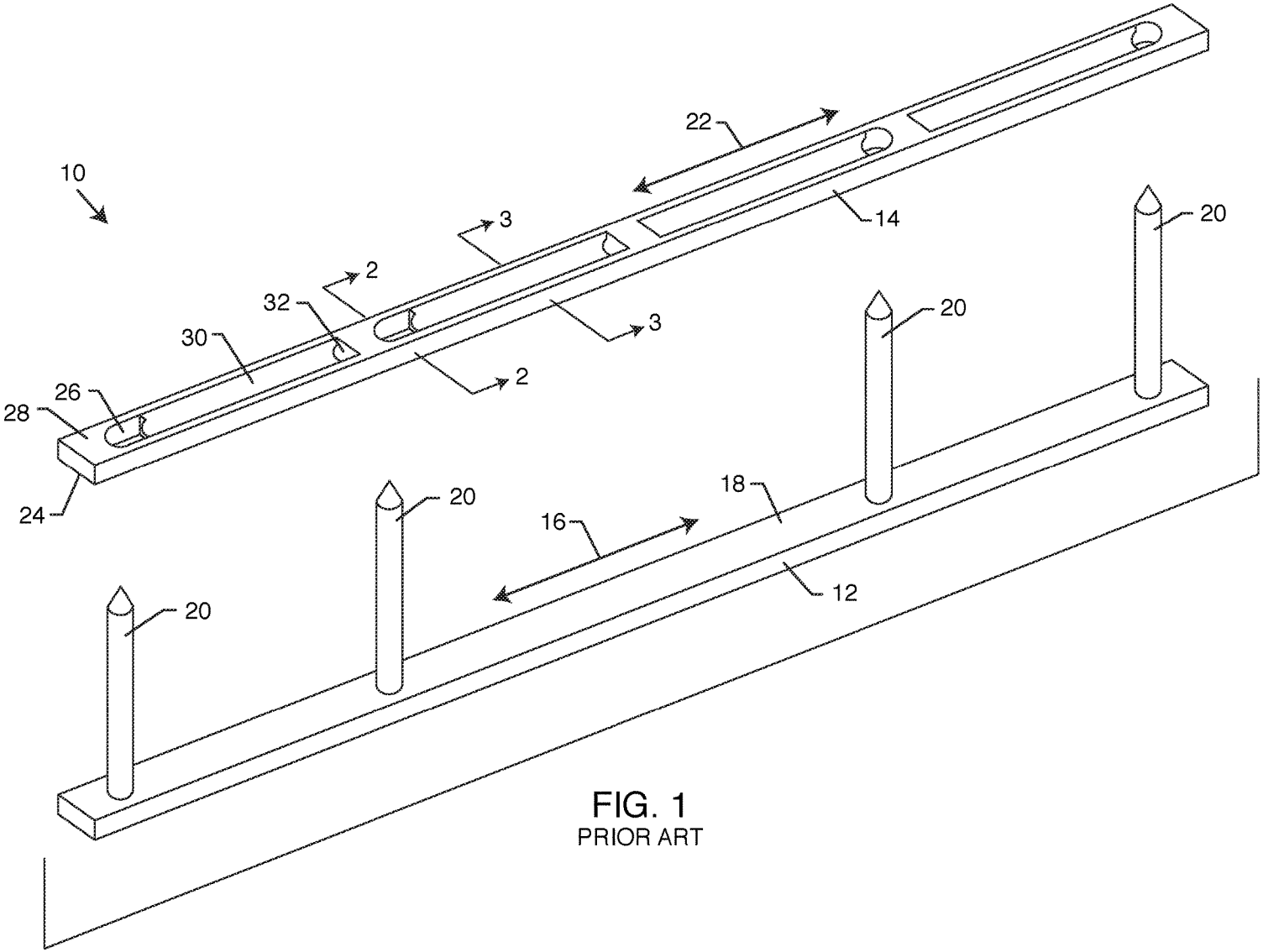
FIG. 1 PRIOR ART
FIG. 1 is a perspective view of a prior art paper binding device.
Figure 3:
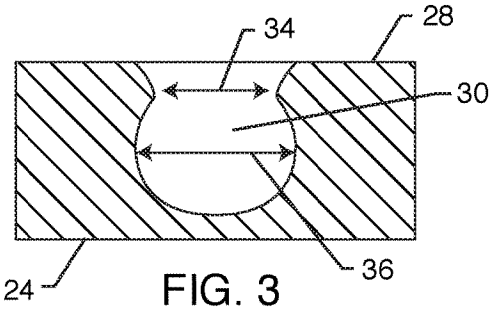
FIG. 3 PRIOR ART
FIG. 3 is a sectional view of the structure of FIG. 1 taken along lines 3-3.
Figure 2:
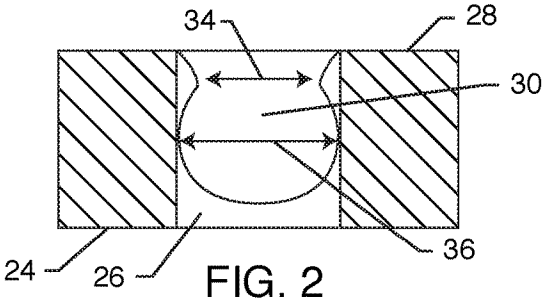
FIG. 2 PRIOR ART
FIG. 2 is a sectional view of the structure of FIG. 1 taken along lines 2-2.
Figure 4:
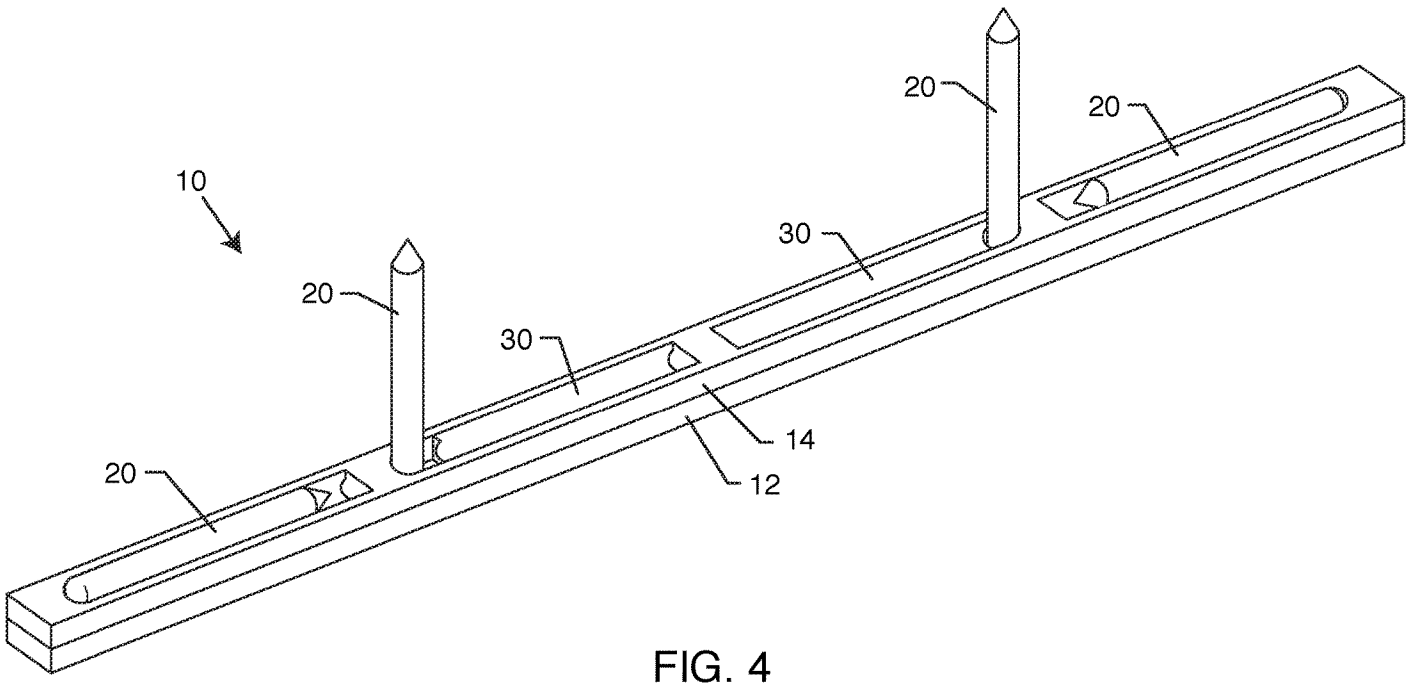
FIG. 4 PRIOR ART
FIG. 4 is a perspective view of the prior art paper binding device of FIG. 1 now in a closed position.
Figure 5:
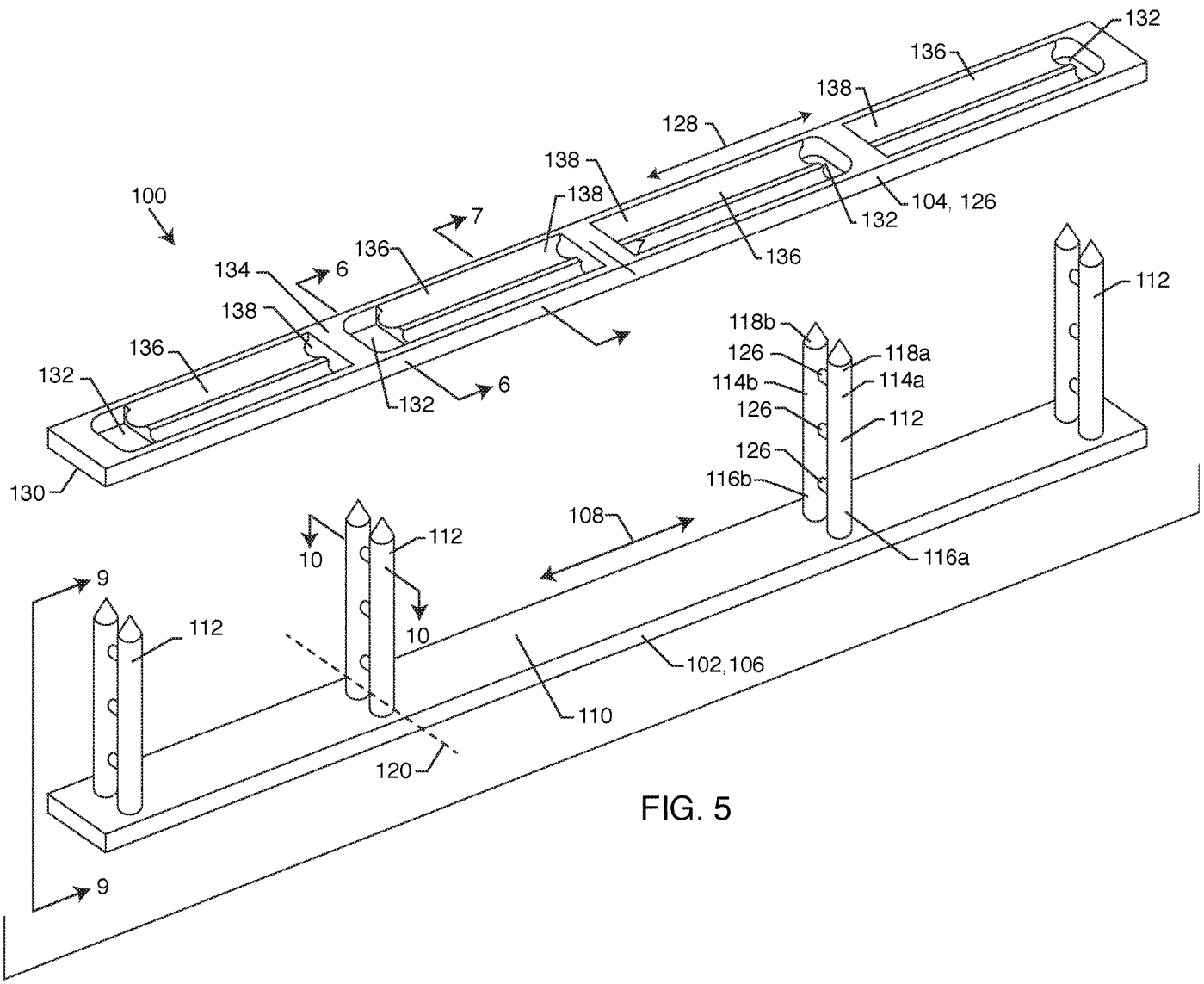
FIG. 5 is a perspective view of an exemplary paper binding device.
Figure 7:
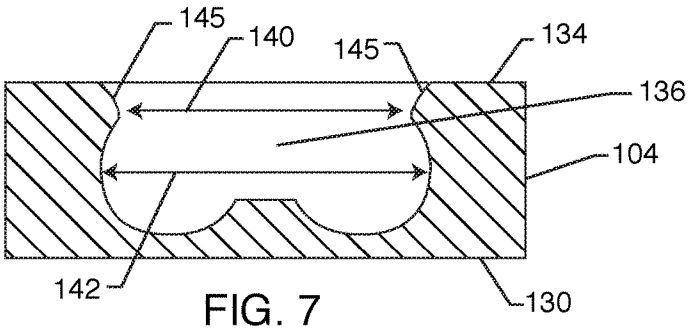
FIG. 7 is a sectional view of the structure of FIG. 5 taken along lines 7-7.
Figure 6:
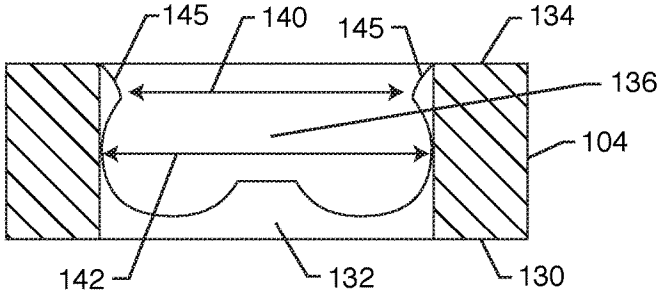
FIG. 6 PRIOR ART
FIG. 6 is a sectional view of the structure of FIG. 5 taken along lines 6-6.
Figure 8:
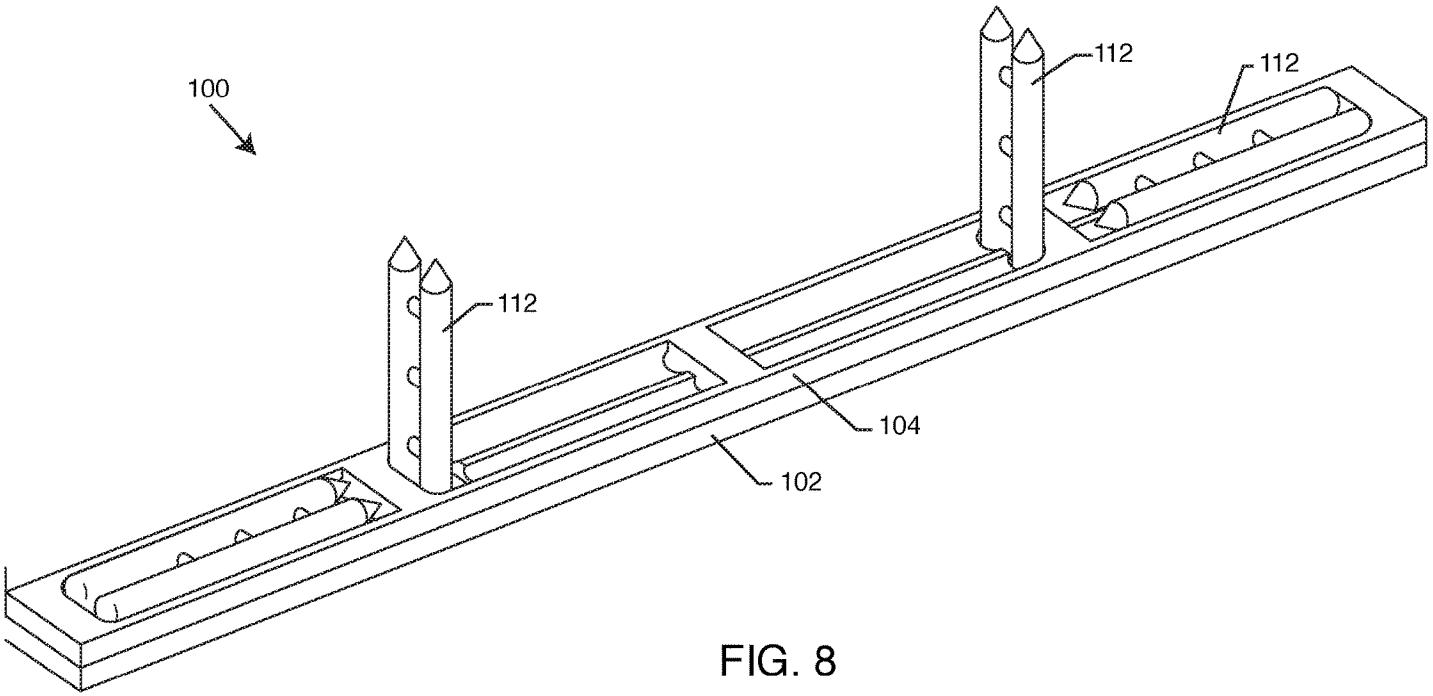
FIG. 8 is a perspective view of the exemplary paper binding device of FIG. 5 now in a closed position.
Figure 9:
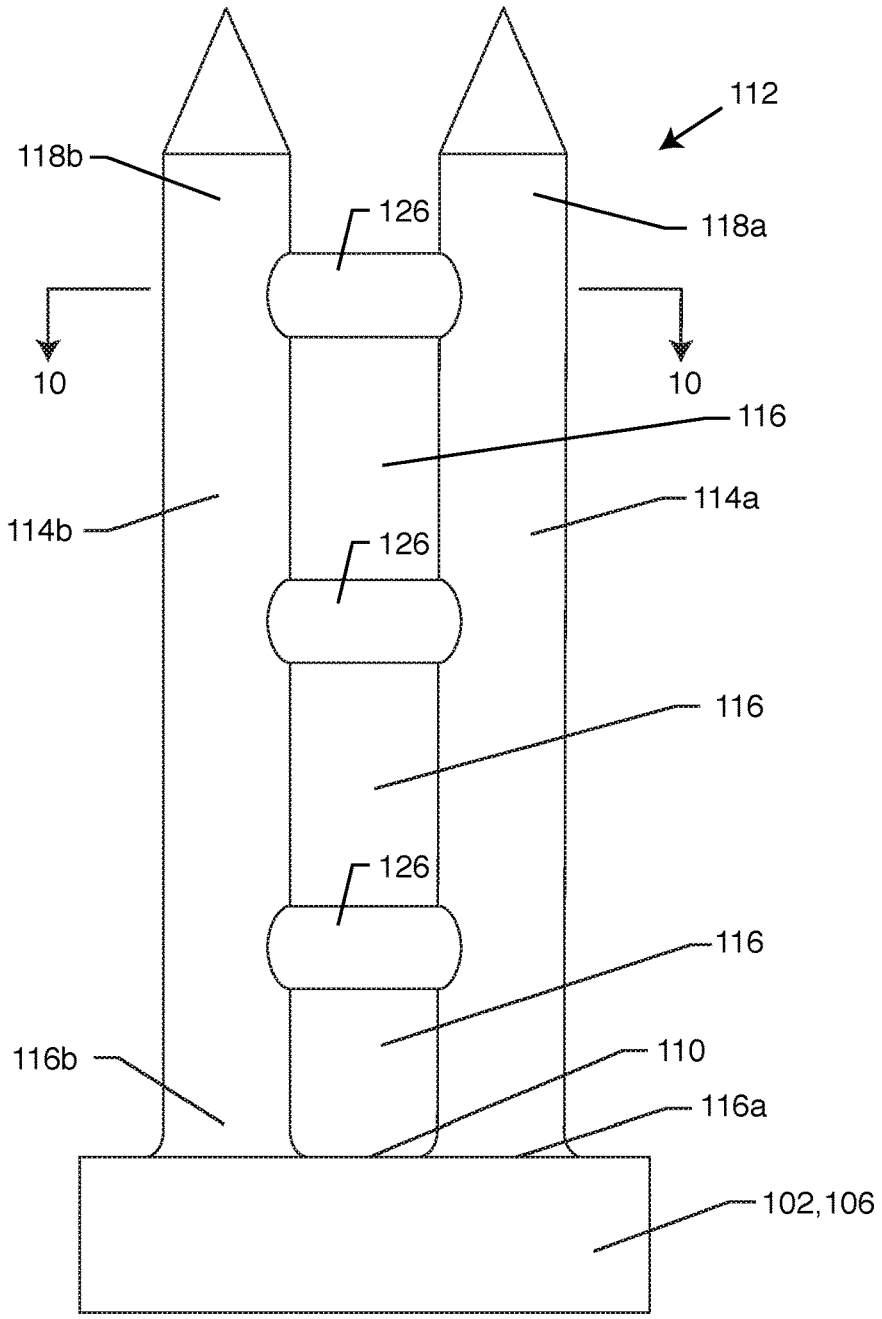
FIG. 9 is a sectional view of the structure of FIG. 5 taken along lines 9-9.
Figure 10:
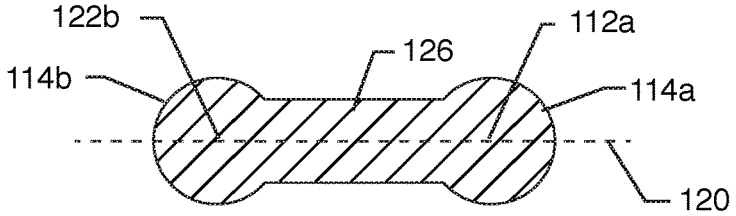
FIG. 10 is a sectional view of the structure of FIG. 5 taken along lines 10-10.

FIG. 5 is a perspective view of an exemplary paper binding device 100 of the present invention. FIG. 6 is a sectional view of the structure of FIG. 5 taken along lines 6-6 and FIG. 7 is a sectional view of the structure of FIG. 5 taken along lines 7-7. The exemplary embodiment of the present invention includes a paper binding device 100 configured to hold a plurality of paper sheets together utilizing aligned holes formed in each of the plurality of sheets. FIG. 8 is a perspective view of the exemplary paper binding device 100 of FIG. 5 now in a closed position where some of the bendable extensions are captured in their respective channels. FIG. 9 is a sectional view of the structure of FIG. 5 taken along lines 9-9 and FIG. 10 is a sectional view of the structure of FIG. 5 taken along lines 10-10.

The paper binding device 100 includes a first part 102 and a second part 104, where the first part 100 is a separate part from the second part 104. The first part 102 includes a first elongated strip 106 elongated along a first longitudinal direction 108. A first cross-section through the first elongated strip perpendicular to the first longitudinal direction has a first outer perimeter shape which includes at least one flat first surface 110. A plurality of bendable extensions 112 extend from the at least one flat first surface 110, wherein the plurality of bendable extensions 112 are spaced along the first longitudinal direction 108.

Each of the plurality of bendable extensions 112 includes two cylindrically-shaped posts 114*a* and 114*b* disposed adjacent to one another and separated by a gap 116. The gap 116 is best shown in FIG. 9. The two cylindrically-shaped posts 114 are connected at each of their proximal ends 116*a* and 116*b* to the at least one flat first surface 110. The two cylindrically-shaped posts 114 extend perpendicular from the at least one flat first surface 110 to each of their respective distal ends 118*a* and 118*b*. The two cylindrically-shaped posts 114 define an alignment line 120 passing through a center 122*a* and 122*b* of each of the two cylindrically-shaped posts 114, wherein the alignment line 120 is perpendicular to the first longitudinal direction 108. A plurality of bridges 126 are connecting the two cylindrically-shaped posts 114 along the gap 116, wherein the plurality of bridges 124 are generally spaced between the proximal end 116 and distal end 118 of the two cylindrically-shaped posts 114.

A second part 104 includes a second elongated strip 126 elongated along a second longitudinal direction 128. A second cross-section through the second elongated strip 126 perpendicular to the second longitudinal direction 128 has a second outer perimeter shape which includes at least one flat second surface 130. The at least one flat second surface 130 is hard to see in FIG. 5 as it underneath the second part 104, but is easier to see in FIGS. 6 and 7.

A plurality of through apertures 132 are disposed from the at least one flat second surface 130 through to an opposite surface 134. The plurality of through apertures 132 are matched to the plurality of bendable extensions 112 from the first part 102 when the first and second parts are mutually aligned to another along the same first 108 and second longitudinal directions 128. A plurality of elongated channels 136 are openly formed in (and/or from) the opposite surface 134 along the second longitudinal direction 128, wherein each elongated channel of the plurality of elongated channels 136 starts at its respective through aperture 132 and extends to a respective channel end 138. Each elongated channel comprises a channel opening 140 along the opposite surface 134 which is smaller than a widest portion of the channel 142 disposed within the second elongated strip 104. As can be seen in FIGS. 6 and 7, the channels 136 are matched to receive and accept the cylindrically-shaped posts 114. To help each post 114 to snap into the channels 136, the channel opening includes a curved lip 145. The curved lip helps locate and facilitate the posts 114 to snap into the channels 136.

As shown in FIG. 8, when the at least one flat first surface 110 is disposed facing the at least one flat second surface 130 and the plurality of bendable extensions 112 are fitted through the plurality of through apertures 132, the plurality of bendable extensions 112 are configured to be manipulated by a user to bend and lock into the plurality of elongated channels 136. FIG. 8 is showing that the two outer bendable extensions 112 have already been closed while the two inner bendable extensions 112 have yet to be closed. Note that FIG. 8 does not show the plurality of papers that would be bound between the first and second parts for simplicity. It is understood that this device 100 can adjust to varying sizes of papers because the bendable extensions 112 may be bent anywhere along their length.

In other exemplary embodiments, the first elongated strip 106 and plurality of bendable extensions 112 may be integrally formed as one continuous material. The first part 102 may then be an injection molded polymer, such as a plastic. Injection molding is a process where a multitude of parts can be cheaply made once the metallic mold has been machined. The second part 104 may also be made from an injection molded polymer. The first part and second part may be made from a same mold during the injection molding process.

The first elongated strip and the second elongated strip may be made in a rectangular cuboid shape. In geometry, a cuboid is a convex polyhedron bounded by six quadrilateral faces, whose polyhedral graph is the same as that of a cube. While mathematical literature refers to any such polyhedron as a cuboid, other sources use cuboid to refer to a shape of this type in which each of the faces is a rectangle (and so each pair of adjacent faces meets in a right angle). This more restrictive type of cuboid is also known as a rectangular cuboid, right cuboid, rectangular box, rectangular hexahedron, right rectangular prism, or rectangular parallelepiped. In a rectangular cuboid, all angles are right angles, and opposite faces of a rectangular cuboid are equal in size. By definition this makes it a right rectangular prism, and the terms rectangular parallelepiped or orthogonal parallelepiped are also used to designate this polyhedron.

While the embodiments shown herein always show the first elongated strip 106 and the second elongated strip 126 as rectangular cuboid shaped, it is understood by those skill in the art that other outer perimeter shapes can be used but where there is still at least one flat first and second surfaces 110 and 130. The flat surfaces are necessary to then abut and press against the plurality of papers for the binding process. However, the rest of the surfaces can take other shapes and forms that deviate from flat and right angled surfaces.

It is also understood by those skilled in the art that the plurality of bendable extensions may include at least two bendable extensions or any number of bendable extensions, including three, four, five, six, seven or "n" number of extensions. The plurality of bridges may also include at least two bridges per each bendable extension or any number of bridges, including three, four, five, six, seven or "n" number of bridges.

Figure 11:
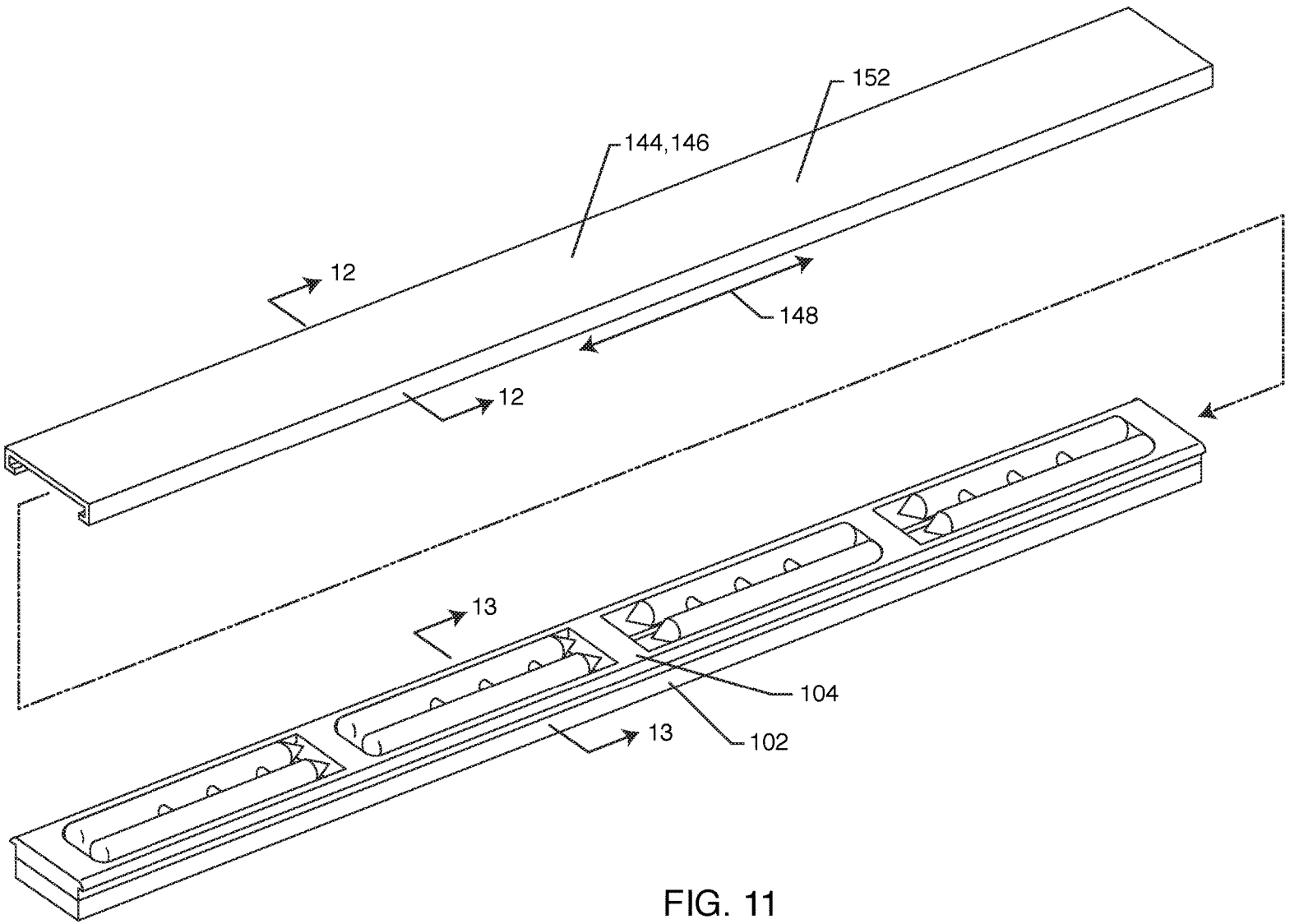
FIG. 11 is a perspective view similar to FIG. 8 now showing a cover part.
Figure 12:
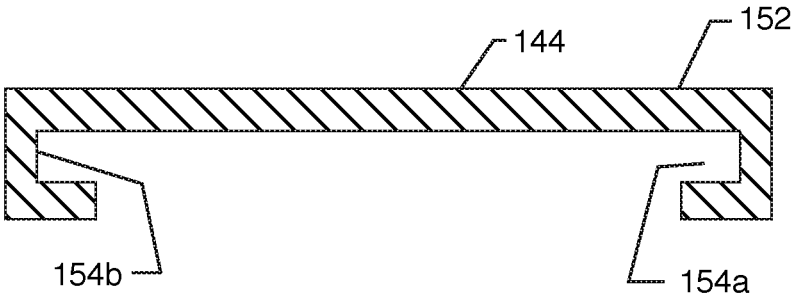
FIG. 12 is a sectional view of the structure of FIG. 11 taken along lines 12-12.
Figure 13:
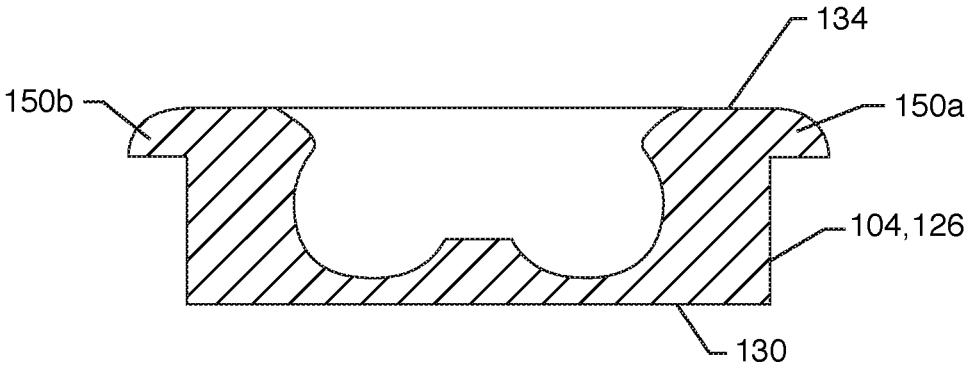
FIG. 13 is a sectional view of the structure of FIG. 11 taken along lines 13-13.
Figure 14:
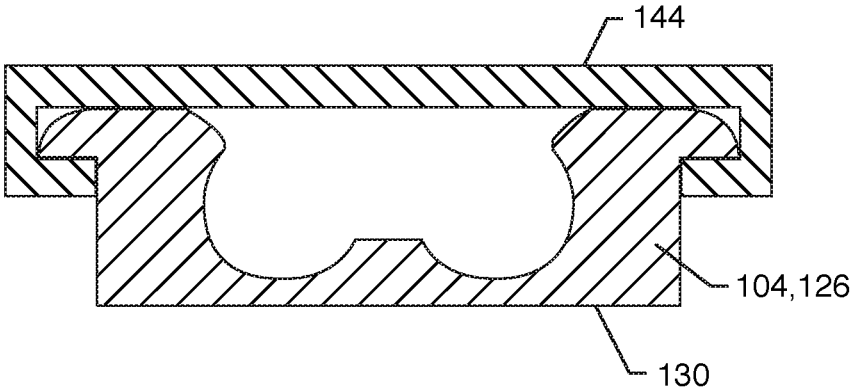
FIG. 14 is a sectional view showing the structures of FIGS. 12 and 13 assembled together.

FIG. 11 is a perspective view similar to FIG. 8 now showing a third (cover) part 144. FIG. 12 is a sectional view of the structure of FIG. 11 taken along lines 12-12 and FIG. 13 is a sectional view of the structure of FIG. 11 taken along lines 13-13. FIG. 14 is a sectional view showing the structures of FIGS. 12 and 13 assembled together.

The third part 144 may include a third elongated strip 146 elongated along a third longitudinal direction 148. The third part 144 is configured to slidably engage with the second part 104 where then the plurality of elongated channels 136 are covered by the third part 144. The first part 102, second part 104 and third part 144 may be made from a same mold during the injection molding process.

As best shown in FIG. 13, the second elongated strip 104 may now include a pair of ridges 150*a* and 150*b* disposed on opposite sides and extending the opposite surface 134 while also being elongated along the second longitudinal direction 128. As best shown in FIG. 12, the third part 144 includes the third elongated strip 146 elongated along the third longitudinal direction 148, wherein a third cross-section (as depicted in FIG. 11) through the third elongated strip 146 perpendicular to the third longitudinal direction 148 has a third outer perimeter shape which includes a cover surface 152 with two oppositely disposed inwardly facing channels 154*a* and 154*b* configured to receive the pair of ridges 150 of the second elongated strip. As best shown in FIG. 14, the third part 144 is configured to slidably engage with the second part 104 where then the plurality of elongated channels 136 are covered by the cover surface 152 of the third part 144.

Figure 15:
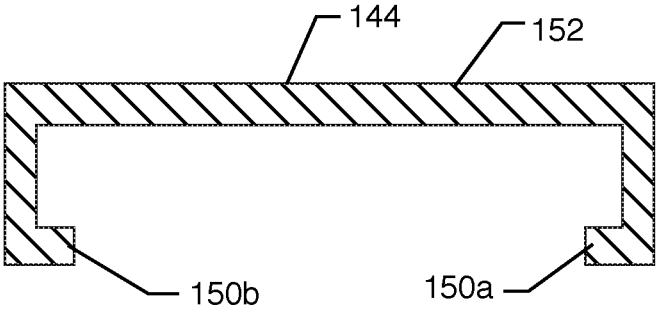
FIG. 15 is a sectional view of another embodiment similar to the view of FIG. 12.
Figure 16:
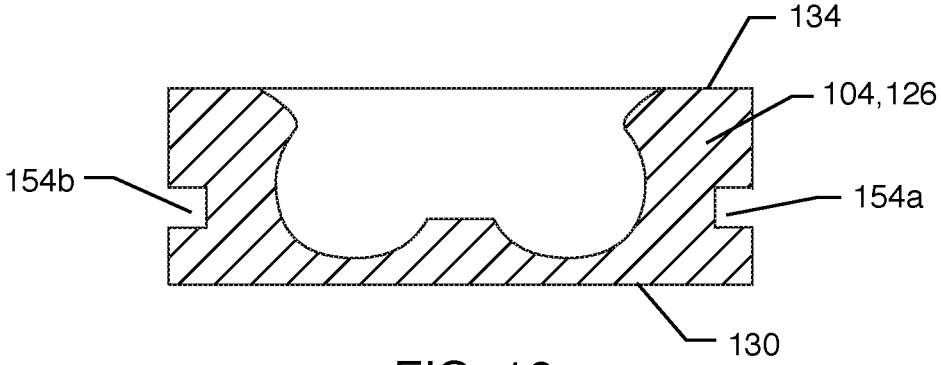
FIG. 16 is a sectional view of another embodiment similar to the view of FIG. 13.
Figure 17:
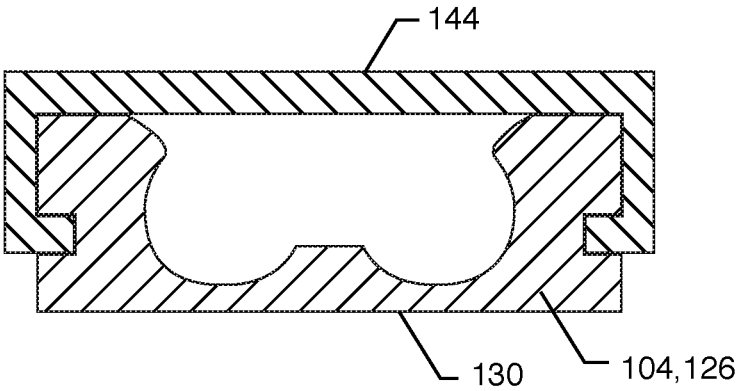
FIG. 17 is a sectional view showing the structures of FIGS. 15 and 16 assembled together.

In an alternative embodiment shown in FIGS. 15-17 it will be understood that the ridges 150 and channels 152 can be swapped between the second part 104 and the third part 144. In this embodiment, the second elongated strip 126 may include two oppositely disposed outwardly facing channels 154 disposed along the second longitudinal direction 128. Now, the third part 144 may include a third elongated strip 146 elongated along a third longitudinal direction 148, wherein a third cross-section through the third elongated strip 146 perpendicular to the third longitudinal direction 148 has a third outer perimeter shape which includes a cover surface 152 with two oppositely disposed inwardly facing ridges 150*a* and 150*b* configured to engaged the two oppositely disposed outwardly facing channels 154 of the second part. The third part 144 is configured to slidably engage with the second part 104 where then the plurality of elongated channels 136 are covered by the cover surface 152 of the third part 144.

Figure 18:
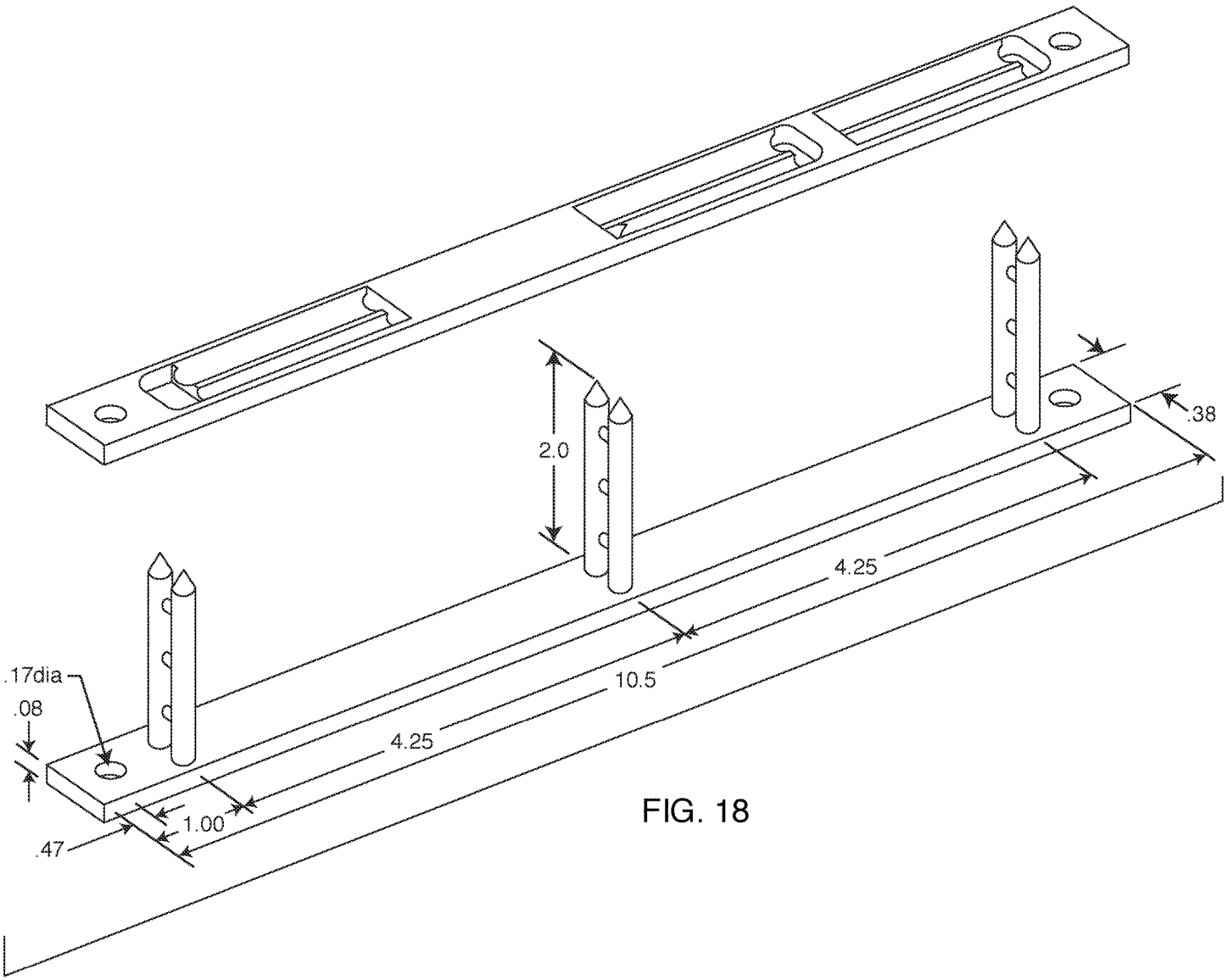
FIG. 18 is another exemplary embodiment of the present invention now showing dimensions in inches.

FIG. 18 shows another exemplary embodiment of the present invention where the spacing between the cylindrically-shaped posts is now made to a standard spacing of 4.25 inches between with three bendable extensions. This means the present invention can be used with standard spacing on most papers produced. Furthermore, the use of two cylindrically-shaped posts for each bendable extension better utilizes the full size of the holes pre-formed in such papers. This leads to a more reliable closure device that secures the paper better. However, the two cylindrically-shaped posts are still able to be bent by a user due to their unique alignment with respect to the longitudinal direction. Also, the use of the three (four, five, six, seven or more) bridges per each plurality of bendable extensions allows the bendable extensions to better snap into their respective elongated channel. The present invention simply works better than the prior art designs due to its advanced design and configuration.

Figure 19A:
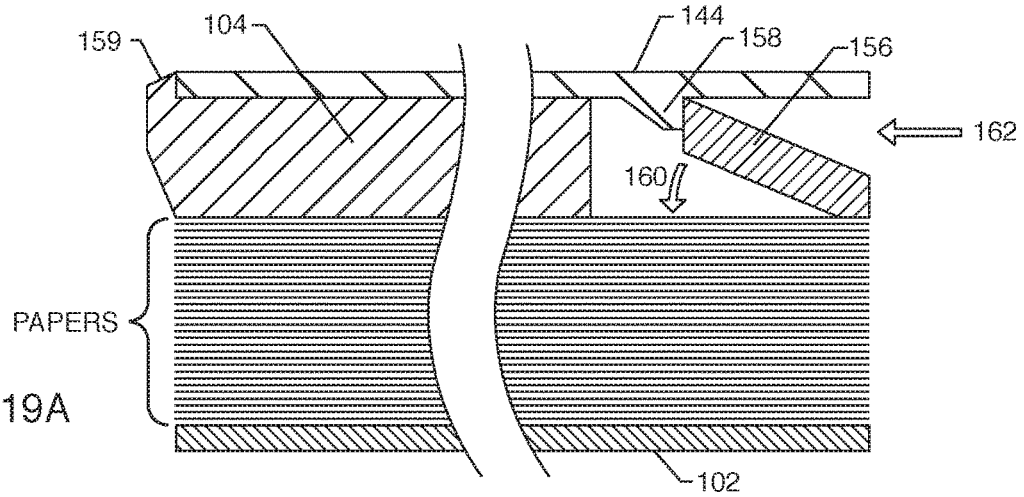
FIG. 19A is a condensed sectional view taken along the first, second and third longitudinal directions now showing a new embodiment where the cover can be removably locked in place by a flexure, where the flexure can be accessed from its open end.
Figure 19B:
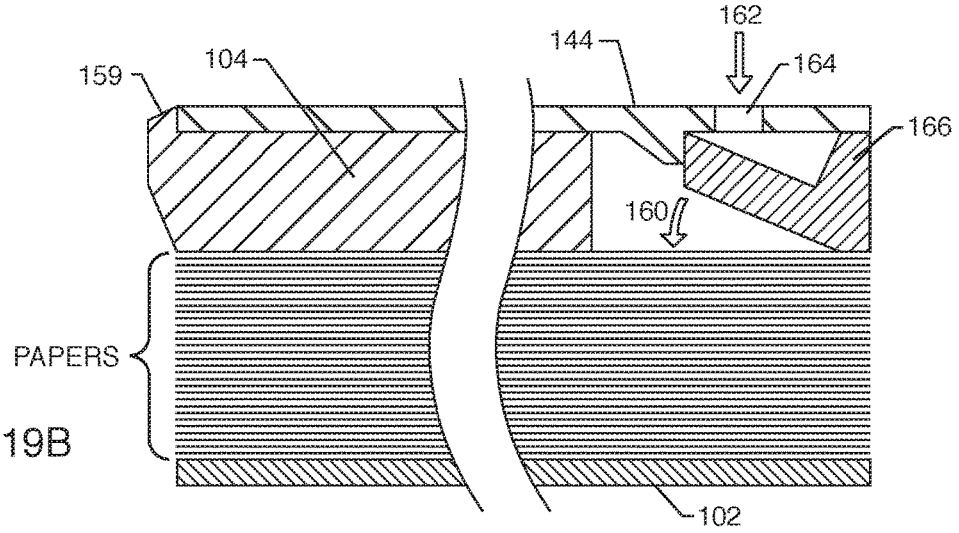
FIG. 19B is a condensed sectional view taken along the first, second and third longitudinal directions very similar to FIG. 19A now showing a new embodiment where the cover can be removably locked in place by a flexure, where the flexure can be accessed through an aperture in the cover.
Figure 19C:
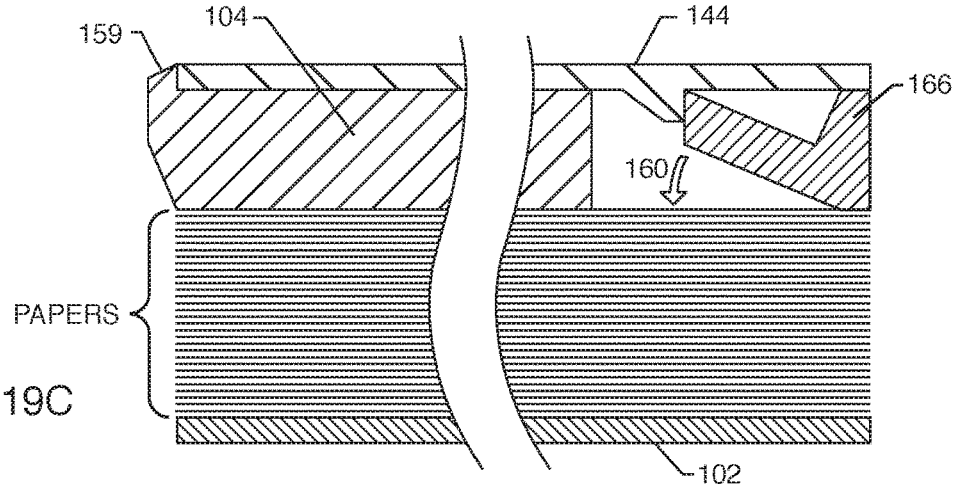
FIG. 19C is a condensed sectional view taken along the first, second and third longitudinal directions very similar to FIG. 19A now showing a new embodiment where the cover can be permanently locked in place by a flexure, where the flexure cannot be accessed through an aperture in the cover or at its end.

FIGS. 19A, 19B and 19C are a series of condensed sectional views taken along the first, second and third longitudinal directions now showing new embodiments of a removably locked cover or a non-removably (permanent) cover. FIGS. 19A-C are condensed views in that it is showing both ends of the structure and the entire middle portions have been removed for convenience of understanding the operations of the parts together with one another. These views also show how the papers are captured between the first part 102 and the second part 104.

FIG. 19A shows that the cover 144 now has a catch 158 disposed along the inside surface of the cover. The second part 104 now has an integrally formed flexure 156. The flexure 156 can be formed in the molding operation that allows it to flex along a direction of arrow 160. When the cover 144 is slid onto the second part 104, the catch 158 abuts the flexure 156 and displaces the flexure 156 in direction 160. As the cover continues to advance, it eventually abuts a stop 159 formed into the second part 104 at its opposite end. The catch 158 has advanced past the flexure 156 and the flexure returns to its original position. At this moment, the cover 144 can no longer be removed as the flexure 156 is now abutting the catch 158. The user can then insert a tool, such as a knife, paperclip or pen into the opening along direction 162. The user can press onto the flexure 156 such that it lowers below the catch 158 therefore allowing the cover 144 to be removed.

FIG. 19B is a view very similar to FIG. 19A but now shows a slightly different embodiment where the second part 104 has a closed end 166 that prevents the access as shown in FIG. 19A. Instead, an aperture 164 is formed in the cover 144 such that the user can again use a tool through the aperture 164 along the access direction 162 to depress the flexure 156.

FIG. 19C is very similar to FIG. 19B, but now the aperture 164 has been removed in the cover. One skilled in the art will now appreciate that the cover 144 can no longer be removed once it has been installed. This is a non-removable or permanent cover. This embodiment may be desired where the user does not want another person from taking sheets out of the binding without it being apparent that the entire document has been tampered with. This version would prevent unscrupulous actors from various nefarious activities.

It will be appreciated that any of the embodiments taught in FIGS. 19A-C can be applied to any of the other embodiments taught herein. Furthermore, it will be understood by those skilled in the art that the flexure 156 can catch 158 have been shown at one end of the parts, yet they could be moved anywhere along the length of the parts, such as in the middle or further away from an edge.

It will also be appreciated that the present invention can be modified to be used with paper having two holes, three holes, four holes, five holes or any realistic number of holes, as this disclosure is not just limited to use with four or three holed paper. In other words, any number of post sets can be used to match the holes of the paper one is trying to bind.

Although several embodiments have been described in detail for purposes of illustration, various modifications may be made to each without departing from the scope and spirit of the invention. Accordingly, the invention is not to be limited, except as by the appended claims.

What is claimed is:

1. A paper binding device configured to hold a plurality of paper sheets together utilizing aligned holes formed in each of the plurality of sheets, the paper binding device comprising:

a first part comprising:

a first elongated strip elongated along a first longitudinal direction;

wherein a first cross-section through the first elongated strip perpendicular to the first longitudinal direction has a first outer perimeter shape which includes at least one flat first surface;

a plurality of bendable extensions extending from the at least one flat first surface, wherein the plurality of bendable extensions are spaced along the first longitudinal direction;

wherein each of the plurality of bendable extensions comprises:

two cylindrically-shaped posts disposed adjacent to one another and separated by a gap, where the two cylindrically-shaped posts are connected at each of a proximal ends to the at least one flat first surface, and where the two cylindrically-shaped posts extend perpendicular from the at least one flat first surface to each of a respective distal ends;

wherein the two cylindrically-shaped posts define an alignment line passing through a center of each of the two cylindrically-shaped posts, wherein the alignment line is perpendicular to the first longitudinal direction;

a plurality of bridges connecting the two cylindrically-shaped posts along the gap, wherein each bridge of the plurality of bridges is spaced between the proximal end and distal end of the two cylindrically-shaped posts;

a second part comprising:

a second elongated strip elongated along a second longitudinal direction;

wherein a second cross-section through the second elongated strip perpendicular to the second longitudinal direction has a second outer perimeter shape which includes at least one flat second surface;

a plurality of through apertures disposed from the at least one flat second surface through to an opposite surface, wherein the plurality of through apertures are matched to the plurality of bendable extensions when the first and second parts are mutually aligned to another along the same first and second longitudinal directions; and a plurality of elongated channels openly formed in the opposite surface along the second longitudinal direction, wherein each elongated channel of the plurality of elongated channels starts at its respective through aperture and extends to a respective channel end;

wherein each elongated channel comprises a channel opening along the opposite surface which is smaller than a widest portion of the channel disposed within the second elongated strip; and wherein when the at least one flat first surface is disposed facing the at least one flat second surface and the plurality of bendable extensions are fitted through the plurality of through apertures, the plurality of bendable extensions are configured to be manipulated by a user to bend and lock into the plurality of elongated channels.

2. The paper binding device of claim 1, wherein the first elongated strip and plurality of bendable extensions are integrally formed as one continuous material.

3. The paper binding device of claim 2, wherein the first part is an injection molded polymer.

4. The paper binding device of claim 3, wherein the second part is an injection molded polymer.

5. The paper binding device of claim 4, wherein the first elongated strip is rectangular cuboid shaped.

6. The paper binding device of claim 5, wherein the second elongated strip is rectangular cuboid shaped.

7. The paper binding device of claim 6, wherein the plurality of bendable extensions comprises at least two bendable extensions.

8. The paper binding device of claim 7, wherein the plurality of bridges comprises at least two bridges.

9. The paper binding device of claim 8, wherein the first part and second part are made from a same mold during an injection molding process.

10. The paper binding device of claim 1, including a third part comprising a third elongated strip elongated along a third longitudinal direction, wherein the third part is configured to slidably engage with the second part and cover the plurality of elongated channels.

11. The paper binding device of claim 10, wherein the first part, second part and third part are made from a same mold during an injection molding process.

12. The paper binding device of claim 1, wherein the second elongated strip includes a pair of ridges disposed on opposite sides of the second elongated strip and extending the opposite surface while also being elongated along the second longitudinal direction, and including a third part comprising a third elongated strip elongated along a third longitudinal direction, wherein a third cross-section through the third elongated strip perpendicular to the third longitudinal direction has a third outer perimeter shape which includes a cover surface with two oppositely disposed inwardly facing channels configured to receive the pair of ridges of the second elongated strip, wherein the third part is configured to slidably engage with the second part and cover the plurality of elongated channels.

13. The paper binding device of claim 1, wherein the second elongated strip includes two oppositely disposed outwardly facing channels disposed along the second longitudinal direction, and including a third part comprising a third elongated strip elongated along a third longitudinal direction, wherein a third cross-section through the third elongated strip perpendicular to the third longitudinal direction has a third outer perimeter shape which includes a cover surface with two oppositely disposed inwardly facing ridges configured to engage the two oppositely disposed outwardly facing channels of the second part, wherein the third part is configured to slidably engage with the second part and cover the plurality of elongated channels.

14. A paper binding device configured to hold a plurality of paper sheets together utilizing aligned holes formed in each of the plurality of sheets, the paper binding device comprising:

an injection molded polymer first part, comprising:

a first elongated strip elongated along a first longitudinal direction;

wherein a first cross-section through the first elongated strip perpendicular to the first longitudinal direction has a first outer perimeter shape which includes at least one flat first surface;

a plurality of bendable extensions extending from the at least one flat first surface, wherein the plurality of bendable extensions are spaced along the first longitudinal direction;

wherein each of the plurality of bendable extensions comprises:

two cylindrically-shaped posts disposed adjacent to one another and separated by a gap, where the two cylindrically-shaped posts are connected at each of a proximal end to the at least one flat first surface, and where the two cylindrically-shaped posts extend perpendicular from the at least one flat first surface to each of a respective distal end;

wherein the two cylindrically-shaped posts define an alignment line passing through a center of each of the two cylindrically-shaped posts, wherein the alignment line is perpendicular to the first longitudinal direction;

a plurality of bridges connecting the two cylindrically-shaped posts along the gap, wherein each bridge of the plurality of bridges is spaced between the proximal end and distal end of the two cylindrically-shaped posts;

wherein the plurality of bridges comprises at least three bridges;

wherein the first elongated strip and plurality of bendable extensions are integrally formed as one continuous material;

wherein the plurality of bendable extensions comprises at least three bendable extensions an injection molded polymer second part comprising:

a second elongated strip elongated along a second longitudinal direction;

wherein a second cross-section through the second elongated strip perpendicular to the second longitudinal direction has a second outer perimeter shape which includes at least one flat second surface;

a plurality of through apertures disposed from the at least one flat second surface through to an opposite surface, wherein the plurality of through apertures are matched to the plurality of bendable extensions when the first and second parts are mutually aligned to another along the same first and second longitudinal directions; and a plurality of elongated channels openly formed in the opposite surface along the second longitudinal direction, wherein each elongated channel of the plurality of elongated channels starts at its respective through aperture and extends to a respective channel end;

wherein each elongated channel comprises a channel opening along the opposite surface which is smaller than a widest portion of the channel disposed within the second elongated strip; and wherein when the at least one flat first surface is disposed facing the at least one flat second surface and the plurality of bendable extensions are fitted through the plurality of through apertures, the plurality of bendable extensions are configured to be manipulated by a user to bend and lock into the plurality of elongated channels.

15. The paper binding device of claim 14, including a third part comprising a third elongated strip elongated along a third longitudinal direction, wherein the third part is configured to slidably engage with the second part and cover the plurality of elongated channels.

16. The paper binding device of claim 14, wherein the first part, second part and third part are made from a same mold during an injection molding process.

17. A paper binding device configured to hold a plurality of paper sheets together utilizing aligned holes formed in each of the plurality of sheets, the paper binding device comprising:

an injection molded polymer first part, comprising:

a first elongated strip elongated along a first longitudinal direction;

wherein a first cross-section through the first elongated strip perpendicular to the first longitudinal direction has a first outer perimeter shape which includes at least one flat first surface;

a plurality of bendable extensions extending from the at least one flat first surface, wherein the plurality of bendable extensions are spaced along the first longitudinal direction;

wherein each of the plurality of bendable extensions comprises:

two cylindrically-shaped posts disposed adjacent to one another and separated by a gap, where the two cylindrically-shaped posts are connected at each of a proximal end to the at least one flat first surface, and where the two cylindrically-shaped posts extend perpendicular from the at least one flat first surface to each of a respective distal end;

wherein the two cylindrically-shaped posts define an alignment line passing through a center of each of the two cylindrically-shaped posts, wherein the alignment line is perpendicular to the first longitudinal direction;

a plurality of bridges connecting the two cylindrically-shaped posts along the gap, wherein each bridge of the plurality of bridges is spaced between the proximal end and distal end of the two cylindrically-shaped posts;

wherein the first elongated strip and plurality of bendable extensions are integrally formed as one continuous material;

an injection molded polymer second part comprising:

a second elongated strip elongated along a second longitudinal direction;

wherein a second cross-section through the second elongated strip perpendicular to the second longitudinal direction has a second outer perimeter shape which includes at least one flat second surface;

a plurality of through apertures disposed from the at least one flat second surface through to an opposite surface, wherein the plurality of through apertures are matched to the plurality of bendable extensions when the first and second parts are mutually aligned to another along the same first and second longitudinal directions; and a plurality of elongated channels openly formed in the opposite surface along the second longitudinal direction, wherein each elongated channel of the plurality of elongated channels starts at its respective through aperture and extends to a respective channel end;

wherein each elongated channel comprises a channel opening along the opposite surface which is smaller than a widest portion of the channel disposed within the second elongated strip;

wherein when the at least one flat first surface is disposed facing the at least one flat second surface and the plurality of bendable extensions are fitted through the plurality of through apertures, the plurality of bendable extensions are configured to be manipulated by a user to bend and lock into the plurality of elongated channels; and a third part comprising a third elongated strip elongated along a third longitudinal direction, wherein the third part is configured to slidably engage with the second part and cover the plurality of elongated channels.

18. The paper binding device of claim 17, wherein the second elongated strip includes a pair of ridges disposed on opposite sides of the second elongated strip and extending the opposite surface while also being elongated along the second longitudinal direction, and including a third part comprising a third elongated strip elongated along a third longitudinal direction, wherein a third cross-section through the third elongated strip perpendicular to the third longitudinal direction has a third outer perimeter shape which includes a cover surface with two oppositely disposed inwardly facing channels configured to receive the pair of ridges of the second elongated strip, wherein the third part is configured to slidably engage with the second part and cover the plurality of elongated channels.

19. The paper binding device of claim 17, wherein the second elongated strip includes two oppositely disposed outwardly facing channels disposed along the second longitudinal direction, and including a third part comprising a third elongated strip elongated along a third longitudinal direction, wherein a third cross-section through the third elongated strip perpendicular to the third longitudinal direction has a third outer perimeter shape which includes a cover surface with two oppositely disposed inwardly facing ridges configured to engage the two oppositely disposed outwardly facing channels of the second part, wherein the third part is configured to slidably engage with the second part and cover the plurality of elongated channels.

20. The paper binding device of claim 17, wherein the first part, second part and third part are made from a same mold during an injection molding process.

* * * * *